US006036239A

United States Patent [19]

Hammersley

[11] Patent Number: 6,036,239

[45] Date of Patent: Mar. 14, 2000

[54] DOOR SECURITY ARRANGEMENT

[76] Inventor: David George Hammersley, Ivy House, Hight Street, Abbots Bromley, Staffordshire, United Kingdom

[21] Appl. No.: 09/068,916

[22] PCT Filed: Nov. 22, 1996

[86] PCT No.: PCT/GB96/02887

§ 371 Date: May 20, 1998

§ 102(e) Date: May 20, 1998

[87] PCT Pub. No.: WO97/20124

PCT Pub. Date: Jun. 5, 1997

[30] Foreign Application Priority Data

Nov. 30, 1995 [GB] United Kingdom ..... 9524480

[51] Int. Cl.[7] ..... E05C 1/06

[52] U.S. Cl. ..... 292/158; 292/347.17; 292/145; 292/304; 292/171

[58] Field of Search ..... 292/158, 341.15, 292/341.17, 144, 145, 153, 304, 302, 35, 36, 74, 139, 341.19, 171, 141, 50

[56] References Cited

U.S. PATENT DOCUMENTS

| | | | |
|---|---|---|---|
| 3,225,575 | 12/1965 | Lucas | 292/139 |
| 3,617,080 | 11/1971 | Miller | 292/38 |
| 3,874,715 | 4/1975 | Beudat | 292/75 |
| 4,192,535 | 3/1980 | Picard | 292/37 |
| 4,227,724 | 10/1980 | Day | 292/145 |
| 4,257,633 | 3/1981 | Rosenberg | 292/304 |
| 4,445,718 | 5/1984 | Nuttall et al. | 292/341.17 |
| 4,493,499 | 1/1985 | Stenglein | 292/158 |
| 4,765,662 | 8/1988 | Suska | 292/92 |
| 4,844,521 | 7/1989 | Langenbach et al. | 292/143 |
| 5,697,654 | 12/1997 | MacDonald | 292/66 |

FOREIGN PATENT DOCUMENTS

| | | |
|---|---|---|
| 914210 | 10/1946 | France . |
| 2622243 | 4/1989 | France . |
| 499002 | 11/1970 | Switzerland . |
| 1269439 | 4/1972 | United Kingdom . |
| 1355381 | 6/1974 | United Kingdom . |
| WO 8801673 | 3/1988 | WIPO . |

*Primary Examiner*—Darnell M. Boucher
*Assistant Examiner*—Clifford B Vaterlaus
*Attorney, Agent, or Firm*—Watts, Hoffmann, Fisher & Heinke Co., L.P.A.

[57] ABSTRACT

A door security arrangement with the frame member which is mountable in a wall alongside the opening edge of a door and has an elongate member slideably mounted therein, the member being substantially the same length of the door edge and being movable from a retracted position in which it lies within the frame member and permits the door to swing past it to an extended position in which it lies alongside and substantially against the inner face of the door and the arrangement including releasable means, located within the frame member which hold the elongate member in its retracted and extended positions and are operable by the normal door locking mechanism.

22 Claims, 1 Drawing Sheet

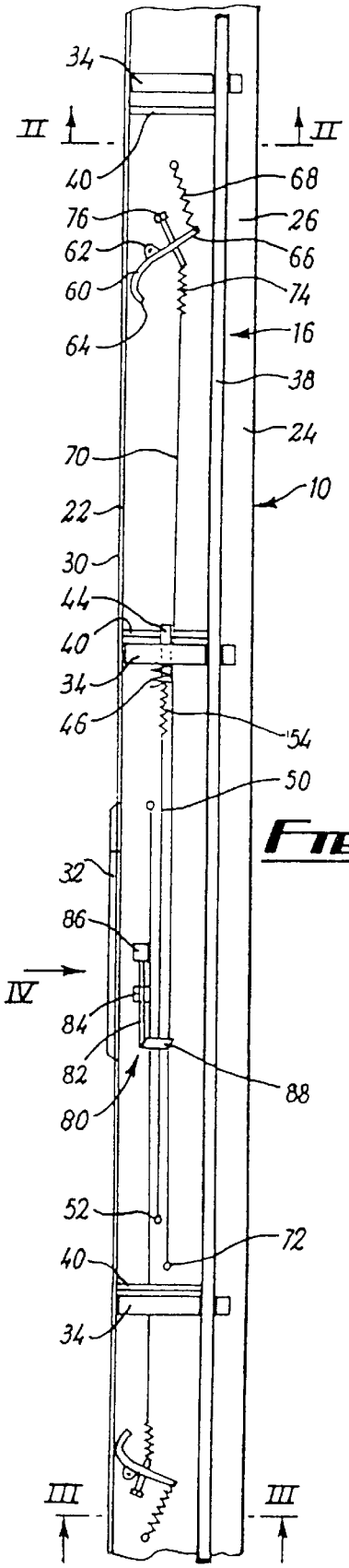
FIG. 1
FIG. 2a
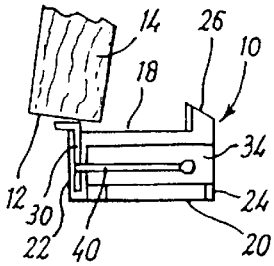
FIG. 2b
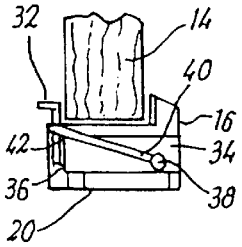
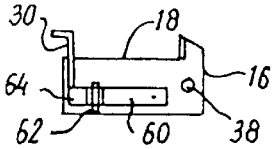
FIG. 3a
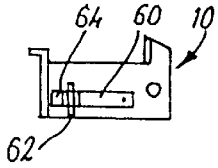
FIG. 3b
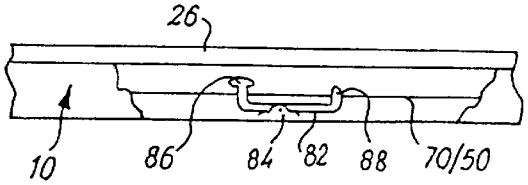
FIG. 4
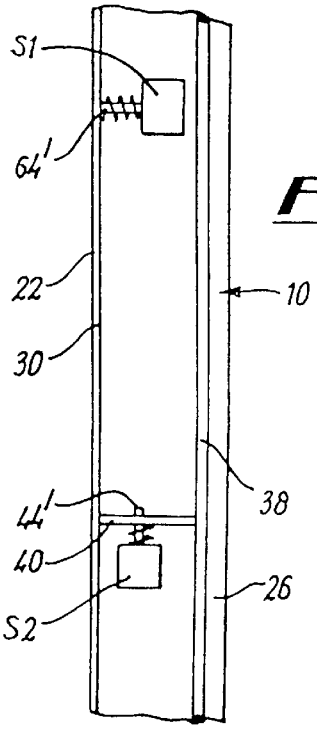
FIG. 5
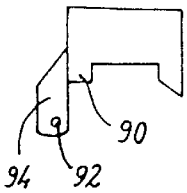
FIG. 6

DOOR SECURITY ARRANGEMENT

The present invention concerns security arrangements and is particularly concerned with security arrangements for doors hingedly mounted in frames but is equally applicable to similar arrangements, for example, windows. In this specification the term door is intended to embrace windows and other similar structures.

There presently exist many means for securing a door in its closed position including mortise locks, bolts and security chains. Whereas each of these arrangements is in itself efficient, it often does not provide the user with sufficient confidence as, for example, a door secured by a mortise lock is vulnerable to attack at those areas of the door remote from the lock's bolt. For example, a door secured by a mortise lock can be jemmied at its top and or bottom. To counteract this difficulty it is normal practice either to include a plurality of mortise locks or to augment a single centrally mounted mortise lock with sliding blots or other security arrangements. This solution not only is relatively costly but involves the user in a number of operations, for example, turning the key in a mortise lock and sliding over one or more bolts. This is inconvenient and often leads to the user failing to utilise all the arrangements. It is also inconvenient in a situation where a secure door has to be opened quickly, for example, in a fire.

Certain more expensive securing arrangements utilise a single operation to move a number of bolts simultaneously. These arrangements are relatively complicated in their construction and mode of operation, consequently they are relatively expensive and are relatively unreliable.

All of the arrangements described above suffer from a further disadvantage in that the bolts, locks etc. are effective only at separate located points, that is where a sliding bolt penetrates a recess.

U.S. Pat. No. 4,844,521 discloses a security lock including an elongate member mounted on or adjacent a door jamb.

According to the present invention there is provided a door security arrangement comprising a frame member adapted for mounting alongside the edge of a door which, in use, is not hinged, an elongate member slideably mounted in the frame member and having a length which is substantially equal to the length of the edge of the door against which it is mounted, the elongate member being moveable from a retracted position in which it lies substantially within the frame member and permits the door to swing past it and an extended position in which it lies alongside and substantially against the inner face of the door, releasable means being provided within the frame member to hold elongate member in its retracted and extended positions.

Preferably said releasable means are mechanically operated. Alternatively, said releasable means are electromagnetically, pneumatically or hydraulically operated.

Preferably control means for controlling the movement of the elongate member are provided within the frame member, said control means comprising a rod pivotally mounted in the frame member with its axis substantially parallel to the longitudinal axis of the frame member and having a plurality of bars projecting therefrom, the free ends of each bar engaging within a corresponding aperture in the elongate member whereby on movement of the elongate member between its retracted and extended positions, the rod and bar assembly pivots about its axis of rotation.

Preferably a release assembly of said releasable means restricts pivotal movement of said rod and bar assembly and comprises a latch slideably mounted relative to the frame member and moveable from a holding position in which it prevents pivotal movement of the rod and bar assembly and consequently movement of the elongate member from the retracted to the extended position, and a release position in which it is moved out of the path of travel of said rod to allow pivotal movement of the rod and bar assembly and consequently extension of the elongate member.

Preferably said latch is spring-biased towards its extended position. Preferably a latch actuation mechanism comprises a spring loaded cable extending between the latch member and an anchorage fixed to the frame member.

Preferably an operating means is provided for moving said latch actuation mechanism, said operating means comprising a lever extending substantially parallel to the longitudinal axis of the member and being pivotally mounted intermediate its ends about an axis transverse to said longitudinal axis, one end of said lever being located in the path of a locking bolt for the door, the other end of said lever being located against said spring loaded cable of said actuation mechanism such that pivotal movement of the lever away from a rest position applies tension to said cable resulting in movement of the latch from its holding to its release position.

Preferably the releasable means includes also holding means for retaining an elongate member in its extended position. Preferably said holding means comprises an abutment member pivotally mounted to the frame member about an axis transverse to the longitudinal axis of the frame member and parallel to the plane of the door when in its closed position, said axis being intermediate the ends of the abutment member, spring means for biasing one end of the abutment member away from the elongate member, said abutment member being provided with an actuation mechanism comprising a spring urged cable extending between the member and an anchorage fixed to the frame member and operable to pivot the actuation member to a position where said one end extends below the edge of the elongate member within the frame member when the elongate member is in its extended position, thereby preventing return of the elongate member to its retracted position until the actuation mechanism is released.

Preferably said actuation member incorporates adjustment means comprising an adjustment member threadably mounted on said abutment member to which the end of said spring cable of the actuation mechanism is attached. Preferably two holding means are provided spaced on either side of said operating means.

Preferably the cables of the actuation means of the holding means are actuable by said operating means to pivot the abutment members about their axes.

Preferably said elongate member has a lifting flap intermediate its ends. Preferably said frame member comprises a channel member with removable lid member. Preferably said channel member and lid member may be formed from sheet steel by a folding operation.

Preferably the channel member comprises a base and two spaced apart limbs extending away from said base. A first limb which, in use, is located on the opening side of the door may be said elongate member slideably mounted thereagainst.

Preferably said limb on the closed side of the door is provided with an upper and inwardly directed extension providing the door jamb.

Preferably said lid has a lip inter-engaging with said extension. Preferably a plurality of spaced apart bearing members are provided within the frame member, each bearing member having an aperture therethrough providing a pivotal mounting for said pivotal rod of the control means and a bearing face at one end thereof combining with the inner face of the shorter limb of the channel member of the frame member to provide a slot in which the elongate member is slideably mounted.

Preferably the latch of the release assembly is slideably mounted in a bearing member.

In an alternative embodiment, incorporating electromagnetic releasable means, the latch of the release assembly is operated by a first solenoid and the abutment member or members is operated by one or more additional solenoids.

Embodiments of the present invention will now be described by way of example only with reference to the accompanying drawings in which:

FIG. 1 shows a partial elevation of a door security arrangement with a lid member thereof removed to show the operating mechanism;

FIGS. 2*a* and 2*b* show cross-sections along the line II, II of FIG. 1 showing an elongate member of the security arrangement in a retracted and extended position;

FIGS. 3*a* and 3*b* show views similar to FIGS. 2*b* and 2*a* along the line III, III of FIG. 1;

FIG. 4 shows a view in the direction of arrow IV of FIG. 1 with a limb of the frame member partially removed;

FIG. 5 shows a view similar to FIG. 1 of an alternative embodiment; and

FIG. 6 shows a view similar to FIGS. 2 and FIGS. 3 of a frame member for the hinged edge of the door.

A security arrangement for a door comprises a frame member 10 which is securely mountable in a door opening and is intended to form the frame member for the opening along the edge 12 of the door 14 opposite to its hinged edge. The dimensions of the frame member are chosen such that they correspond to dimensions of existing standard door frames.

The frame member is conveniently formed from sheet steel and comprises two components formed by pressing, namely a channel member 16 and a lid member 18. It can be best seen from FIGS. 2 and 3, the channel member comprises a base 20 with a first limb 22 extending therefrom and a second limb 24 extending therefrom and having an upper extension 26 comprising inwardly and downwardly deformed portions defining the door jamb, against which the closed door abuts. The lid member 18 has an 'L' shaped configuration and extends across the open top of the channel with its upwardly deformed end hooked within the extension 26 of the limb 24. The lid 18 is fixed to the channel member by removable fixing screws (not shown) and the end of the lid adjacent to the limb 22 is spaced therefrom to provide a slot in which an elongate member 30 is slideably mounted.

The elongate member 30 comprises a strip of steel which extends along substantially the entire length of the frame member and consequently along the substantially the entire length of the door edge, and is provided with a lifting handle 32 intermediate its ends.

A plurality of bearing members 34 are fixed within the frame member, the ends 36 of each bearing member adjacent to the shorter limb 22 of the frame member being spaced from the inner face of said limb by a distance which is only slightly greater than the thickness of the elongate member such that the elongate member can be guided in the slot defined between said ends 36 and the inner face of the limbs 22. The elongate member can be manually moved from a retracted position (illustrated in FIGS. 2*a* and 3*b*) in which it allows the door 14 to swing towards and away from its closed position as illustrated in FIG. 2*a* to an extended position, as illustrated in FIGS. 2*b* and 3*a*, in which it lies in the path of travel of the opening door. In this extended position the elongate member provides means for securing the door in the closed position along the entire length of the door.

Releasable means, which are described in detail below, are provided for holding the elongate member in its extended and retracted position, the releasable means conveniently being actuated by a mortise lock of known design, and being such that when the mortise lock is actuated to move its bolt into the frame member, the releasable means allows the elongate member, which until actuation of the mortise lock had been held in its retracted position, to move to its extended position. The releasable means then fixes the elongate member in its extended position thereby securing the door until the mortise lock is actuated again to withdraw its bolt out of the frame member.

A control means is provided for holding the elongate member in its retracted position until the mortise lock bolt extends into the frame member. The control means comprises a circular cross-section rod 38 rotatably mounted in said bearing members 34 with its longitudinal axis parallel to the longitudinal axis of the frame member.

At intervals along its length the rod 38 has bars 40 fixed thereto and extending radially therefrom, the bars extending across the frame member such that their free ends can penetrate apertures 42 formed in the elongate member 30 so that when the elongate member 30 is moved from the retracted to the extended position the bar and rod assembly 38,40 pivots about said bearing blocks.

To prevent unwanted extension of the elongate member release means are provided. Said release means comprise a latch 44 slideably mounted in a bearing block 34, the axis of the latch being parallel to the longitudinal axis of the frame member. The latch 44 is biased by a spring 46 towards the position where it overlies the rod 40 when the elongate member 38 is in its retracted position, thus movement away from the retracted position is prevented by inter-engagement of the latch 44 with the bar 40.

Actuation means are provided to retract the latch 44 out of engagement with the bar 40. The actuation means comprises a wire cable 50 extending from an anchorage 52 fixed to the frame member to an attachment point with a tension spring 54 attached to the end of the latch so that a pull applied to the cable 50 retracts the latch against the action of the return spring 46.

The other assembly of the releasable means comprises holding means illustrated in FIGS. 1, 3*a* and 3*b* for holding the elongate member 30 in its extended position.

Two holding means are provided adjacent the top and bottom of the frame member and each comprises an abutment member 60 pivotally mounted intermediate its ends about an axis 62 which lies in the plane of the face of the door and transverse to the longitudinal axis of the frame member. One end 64 of the abutment member is formed into a hook shape and the other end 66 has a tension spring 68 attached thereto to bias the hooked end 64 of the abutment member 60 in a direction away from the elongate member.

An actuation means is provided for each abutment member and comprise cable 70 extending between an anchorage 72 fixed to the frame member and a tension spring 74 attached between the free end of the cable and an adjusting member 76 threadably mounted in the abutment member 60. The adjusting member 76 is adjusted after assembly such that with no pull applied to the cable 70 the hooked end 64 of the abutment member is held free of the elongate member and applying a pulling force to the cable overcomes the force of the spring 68 biasing the abutment member 60 away from the elongate member so that the hooked end 64 of the abutment member is held against the side of the elongate member. When the elongate member is moved to its extended position the hooked end moves below the extended elongate member until it abuts the inner face of the limb 22 of the frame member. While the pull on the cable is maintained the abutment member prevents movement of the elongate member from the extended position as shown in FIG. 3*a* to the retract position as shown in FIG. 3*b* thereby causing the door to be secured.

The pull to the cable 70 of the actuating means for the abutment member and the cable 50 of the actuating means of the latch 44 is supplied by an operating means 80 comprising a lever 82 pivotally mounted to the frame member 10 about an axis 84 which is transverse of the longitudinal axis of the frame member. A first end 86 of the lever 82 has a bearing pad provided thereon and is located in the path of travel of the bolt of a mortise lock (not shown) mounted in a normal manner in the door. The operating cables 50,70 of the release means pass over the lifting extension 88 formed on the other end of the lever 82 and it will be realised, therefore, that when the bolt of the mortise member is moved into the frame member by turning the key in the lock, the lever 82 pivots to apply a pull to the cables 70 and 72 so that the latch 44 is moved out of the path of the bar 40 to allow the user to pull the elongate member from its retracted to its extended position at which point the ends 64 of the abutment members under the action of the spring 74 move under the elongate member to prevent its movement back to the retracted position until the key is again turned in the mortise lock to retract its bolt thereby allowing the lever 82 of the operating means to return to its rest position whereby no pull is exerted on the cables 50 and 70 and the abutment members move from under the elongate member, allowing it to be returned to its retracted position at which stage the return spring 46 of the latch allows the latch to move back to its extended position.

As illustrated in FIG. 6 the configuration of the door frame on the hinged side of the door corresponds to that illustrated in FIGS. 1 to 3 but on the opening side of the frame there is provided an extension 90 which corresponds to the elongate member in its extended position, that is when the door is closed its edge on the hinge side is accommodated within a recess. To allow the door to close in this manner its hinge axis 92 must be off-set and a hinge pin is held in a bracket 94 fixed to the door frame.

In the modification shown in FIG. 5 the release means are electro-mechanically operated. The abutment member 64' is a spring urged bolt operated by a first solenoid S1 in such a way that in a door locking mode with the elongate member 30, which is equivalent to the elongate member illustrated in FIG. 1, in the extended position the bolt 64' is extended to engage the elongate member 30 and hold it in the extended position.

A second solenoid S2 causes extension and retraction of a spring urged bolt 44' which operates on the bar 40 of the control means a manner similar to the latch 44 described above.

Various other modifications can be made without departing from the scope of the invention as claimed, for example, the actuating mechanisms for the abutment members and latch described with reference to FIGS. 1 to 4 can be replaced by rods and can take alternative forms. The elongate member 30 need not extend all the length of the door edge but it is preferable that it does for increased security.

Alternative control means can be provided for holding the elongate member in its retracted position and alternative operating means can be provided, for example, the lever 80 could be operated by a handle rather than by the bolt of a mortise lock. It is however preferable that the mortise lock operation is provided so that the frame member can be utilised to replace an existing conventional frame member.

Equivalent elongate members can be provided in a suitable top from and/or door step to overlie the top and/or bottom edges of the door. They can be connected to the elongate member 30 to move in unison thereto.

A further modification enables the elongate member to be operated from the other side of the door. In this modification an opening bar extends from the rod 38 in the opposite direction to the bars 40 and penetrates an aperture in the limb 16 of the frame member. Movement of the opening bar causes movement of the elongate member between the extended and retracted position.

The solenoids described above with reference to FIG. 5 can be replaced by hydraulic or pneumatic means.

I claim:

1. A door security arrangement comprising:

a) an elongate frame member adapted for mounting in a door opening as part of a door frame alongside a side of a door;

b) an elongate member slideably mounted in the frame member and having a length which is adapted to be substantially equal to the length of the side of such door against which the elongate member is to be mounted, the elongate member being moveable from a retracted position substantially within the frame member to permit such door to swing past the elongate member and an extended position adapted to overlie an inner face of such door;

c) control means positioned within the frame member for controlling the movement of the elongate member, d) the control means comprising:

i) a rod mounted in the frame member for rotation about the longitudinal axis, the longitudinal axis being substantially parallel to an elongate dimension of the frame member, ii) the rod having a plurality of bars projecting transversely therefrom;

iii) each bar having a free end extending into a corresponding aperture in the elongate member whereby on movement of the elongate member between the retracted and extended positions the rod rotates about the axis of rotation; and, e) releasable means positioned within the frame member to hold the elongate member selectively and one at a time in the retracted and extended positions, the releasable means being actuatable to allow the elongate member to be moved between the retracted and extended positions.

2. An arrangement as claimed in claim 1, wherein said releasable means (44,60,80) are mechanically operated.

3. An arrangement as claimed in claim 1, characterised in that said releasable means (44,60,80) is a selected one of electro-magnetically, pneumatically and hydraulically operated.

4. An arrangement as claimed in claim 1, characterised in that said releasable means (44,60,80) includes a release assembly for restricting rotation of said rod (38) and comprises a latch (44) slideably mounted relative to the same member (10) and moveable from a holding position in which the latch coacts with one of the bars to prevent rotation of the rod and consequently movement of the elongate member (30) from the retracted to the extended position, to a release position in which the latch is moved out of a path of travel of said one bar to allow rotational movement of the rod and consequently extension of the elongate member (30).

5. An arrangement as claimed in claim 4, characterised in that said latch (44) is spring-biased (46) towards the holding position.

6. An arrangement as claimed in claim 4, characterised in that a latch (44) actuation mechanism comprises a spring (54) loaded cable (50) extending between the latch (44) and an anchorage (52) fixed to the frame member (10).

7. An arrangement as claimed 6, characterised in that an operating means (80) is provided for moving said latch actuation mechanism, said operating means (80) comprising a lever (82) extending substantially parallel to the elongate dimension of the frame member the lever being pivotally mounted intermediate its ends for rotation about an axis (84) transverse to said elongate dimension, said lever (82) having an end located when in use in the path of a locking bolt for such door (14), the lever (82) having another end located against said spring loaded cable (50) such that pivotal movement of the lever (82) away from a rest position applies tension to said cable (50) resulting in movement of the latch (44) from the holding position to the release position.

8. An arrangement as claimed in claim 7, characterised in that the releasable means (44,60,80) includes a holding means for retaining the elongate member (30) in its extended position.

9. An arrangement as claimed in claim 8, characterised in that said holding means comprises an abutment member (60) pivotally mounted on the frame member for rotation about an axis (62) transverse to the elongate dimension and parallel to a plane of such door (14) face when such door is in a closed position, said abutment member axis (62) being intermediate the ends of the abutment member (60), spring means (68) for biasing one end (64) of the abutment member (60) away from the elongate member (30), said abutment member (60) being provided with an actuation mechanism comprising a spring urged cable (70) extending between the abutment member (60) and an anchorage (72) fixed to the frame member (10) and operable to pivot the abutment member (60) to a position wherein said one end (64) extends below the elongate member (30) within the frame member (10) when the elongate member (30) is in the extended position, thereby preventing return of the elongate member (30) to the retracted position until the actuation mechanism is released.

10. An arrangement as claimed in claim 9, characterised in that said actuation mechanism incorporates adjustment means comprising an adjustment member (76) threadably mounted on said abutment member (60) to which the end of said spring cable (70) of the actuation mechanism is attached.

11. An arrangement as claimed in claim 9, characterised in that the latch (44) is operated by a first solenoid (S1) and the abutment member (60) is operated by an additional solenoid (S2).

12. An arrangement as claimed in any of claim 8, characterised in that two holding means are provided spaced on either side of said operating means (80).

13. An arrangement as claimed in claim 12, characterised in that cables (70) of the holding means are actuatable by said operating means to pivot abutment members (60) about their axes.

14. An arrangement as claimed in claim 1, characterised in that said elongate member (30) has a lifting flap (32) intermediate its ends.

15. An arrangement as claimed in claim 1, characterised in that said frame member (10) comprises a channel member (16) with removable lid member (18).

16. An arrangement as claimed in claim 15, characterised in that said channel member (16) and lid member (18) are formed from sheet steel by a folding operation.

17. An arrangement as claimed in claim 15, characterised in that the channel member (16) comprises a base (20) and two spaced apart limbs extending away from said base (20).

18. An arrangement as claimed in claim 17, characterised in that a first limb (22) which, in use, is located on the opening side of the door (14) has said elongate member (30) slideably mounted thereagainst.

19. An arrangement as claimed in claim 17, characterised in that a second limb (24) on the closed side of the door is provided with an upper and inwardly directed extension (26) providing the door (14) jamb.

20. An arrangement as claimed in claim 19, characterised in that said lid (18) has a lip inter-engaging with said extension (26).

21. An arrangement as claimed in claim 17, characterised in that a plurality of spaced apart bearing members (34) are provided within the frame member (10), each bearing member (34) having an aperture therethrough providing a mounting for said rod and each bearing member having a bearing face coacting with an inner face of a shorter one of the limbs (22) to provide a slot in which the elongate member (30) is slideably mounted.

22. A door security arrangement comprising a frame member adapted for mounting alongside a door characterised in that the arrangement includes an elongate member (30) slideably mounted in the frame member (10) and having a length which is adapted to be substantially equal to the length of a side of the door (14) against which the elongate member is mounted, the elongate member (30) being moveable from a retracted position in which the elongate member lies substantially within the frame member (10) and permits the door (14) to swing past the elongate member and an extended position in which the elongate member is adapted to lie alongside and substantially against an inner face of the door (14), releasable means (44,60,80) within the frame member (10) to hold the elongate member (30) in retracted and extended positions control means for controlling the movement of the elongate member (30), the control means being within the frame member (10), said control means comprising a rod (38) rotatably mounted in the frame member (10) with an axis of rotation substantially parallel to an elongate dimension of the fame member (10), the rod having a plurality of bars (40) projecting therefrom to form a rod and bar assembly, the free ends of each bar (40) engaging within a corresponding aperture (42) in the elongate member (30) whereby on movement of the elongate member between the retracted and extended positions, the rod and bar assembly rotates about the axis of rotation.

* * * * *